US005366225A

United States Patent [19]

Lazar

[11] Patent Number: 5,366,225

[45] Date of Patent: Nov. 22, 1994

[54] GOLF SWING TRAINING APPARATUS

[76] Inventor: Lester Lazar, 12150 SW. 92nd Ave., Miami, Fla. 33176

[21] Appl. No.: 231,743

[22] Filed: Apr. 25, 1994

[51] Int. Cl.[5] ..... A63B 69/36

[52] U.S. Cl. ..... 273/185 C; 273/58 C

[58] Field of Search ..... 273/185 C, 185 D, 58 C, 273/200 R, 200 A, 200 B, 26 E, 29 A, 184 B

[56] References Cited

U.S. PATENT DOCUMENTS

| | | | |
|---|---|---|---|
| 1,419,636 | 6/1922 | MacDonald | 273/186.1 |
| 2,933,681 | 4/1960 | Crain | 273/186.1 X |
| 3,475,026 | 10/1969 | Cooper | 273/26 R |
| 3,529,823 | 9/1970 | Garver | 273/26 E |
| 4,664,375 | 5/1987 | Tetreault | 273/26 E |
| 5,028,051 | 7/1991 | Schulz | 273/200 B X |

*Primary Examiner*—George J. Marlo
*Attorney, Agent, or Firm*—Robert M. Downey

[57] ABSTRACT

A golf swing training apparatus for practicing swinging of a golf club such that a head of the club passes through a proper swing path when striking a golf ball, the apparatus including a base plate structured for anchoring to a support surface and a pair of arm members removably attachable to the base plate in an upright position at one of a plurality of select locations between the opposite ends of the base plate such that distal end zones of the arm members are disposed in spaced relation above the support surface. First and second tether assemblies each include a tethering cord having an upper looped end rotatably supported on a respective one of the distal end zones of the arm members and an opposite end having a ball fixedly attached thereto and supported in hanging relation above the support surface, each of the balls on the respective tethering assemblies being disposed in spaced relation relative to one another, such that when the balls are sequentially struck by the club head as it passes through the proper swing path, they are caused to rotate about the distal end zone of the respective arm member.

7 Claims, 1 Drawing Sheet

GOLF SWING TRAINING APPARATUS

BACKGROUND OF THE INVENTION

1. Field of the Invention

The present invention relates to golf swing training devices and, more particularly, to swing training apparatus of the type in which a tethered ball rotates about a horizontal axis when the ball is struck by a golf club head.

2. Description of the Related Art

It is a commonly accepted principle by golf professionals and other golf experts that during a segment of a proper golf swing the club head travels through a straight path just prior to, during and just after striking the golf ball. The straight path through which the club head moves when hitting the ball should be in alignment with the target at which the golfer is hitting the ball. Thus, if the club head is moving through this straight path, with the club face square to the ball, the golf ball will not hook or slice but, rather, will travel in a straight line in alignment with the straight path of movement of the club head as it is hitting the ball.

The art is crowded with numerous swing training devices specifically designed to enable a golfer to practice hitting a ball. Some of these devices include a tethered ball which rotates about a horizontal axis when the ball is struck by the golf club head. This type of device can be seen in the U.S. patent to Moffatt, U.S. Pat. Nos. 4,113,257 and 2,929,632. Similar type golf swing training devices are disclosed in the U.S. patents to Holley, U.S. Pat No. 3,194,557 and Schafer, U.S. Pat. No. 3,827,696.

While the golf swing training devices in the related art are suitable to enable a golfer to practice hitting a golf ball in a confined area, without having to retrieve the ball once hit, none of these devices are structured to train a golfer to swing the club head through a straight path segment just prior to, during and just after striking the golf ball.

SUMMARY OF THE INVENTION

The present invention is directed to a golf swing training apparatus for practicing swinging of a golf club and, specifically, for training a golfer to cause the head of the club to pass through a proper swing path prior to, during and just after striking a golf ball. The swing training apparatus of the present invention includes a base plate having a top side and a bottom side and means for anchoring the base plate to a ground or floor surface. A pair of individual arm members, having a generally L-shape configuration each include a vertical extension with a lower proximal end zone and a horizontal extension having a distal end zone. The arm members are each individually attachable to the base plate at select positions therealong such that the vertical extensions are disposed in a substantially upright manner, with the distal end zones disposed in spaced relation to one another above the support surface.

First and second tether assemblies each include a tethering cord having an upper end rotatably secured to a respective one of the proximal distal end zones of the arm members, such that the tethering cords hang downwardly therefrom in spaced, parallel relation to one another. The tether assemblies each further include a ball fixedly attached to a lower end of a corresponding one of the respective tethering cords, wherein the balls are supported in spaced relation above the support surface in horizontal alignment with one another along a predetermined proper swing path of the golf club head. Each of the tether assemblies are structured and disposed to cause the respective ball to rotate about a horizontal axis defined by the horizontal extension of the arm members, upon striking the ball with the golf club head as the club head moves through the swing path.

With the foregoing in mind, it is a primary object of the present invention to provide a golf swing training apparatus which is specifically designed to train a golfer to swing a golf club such that the club head travels through a straight path just prior to, during and just after striking a golf ball.

It is a further object of the present invention to provide a golf swing training apparatus which includes two individual tethered balls disposed in spaced relation to one another along a swing path segment of a proper golf swing.

It is yet a further object of the present invention to provide a golf swing training apparatus comprising a pair of individual tethered balls supported in spaced relation to one another wherein the apparatus is structured to be anchored to either a ground surface or, alternatively, a platform, enabling the apparatus to be used either indoors or outdoors.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figures 1, 2, 3, 4, 5:
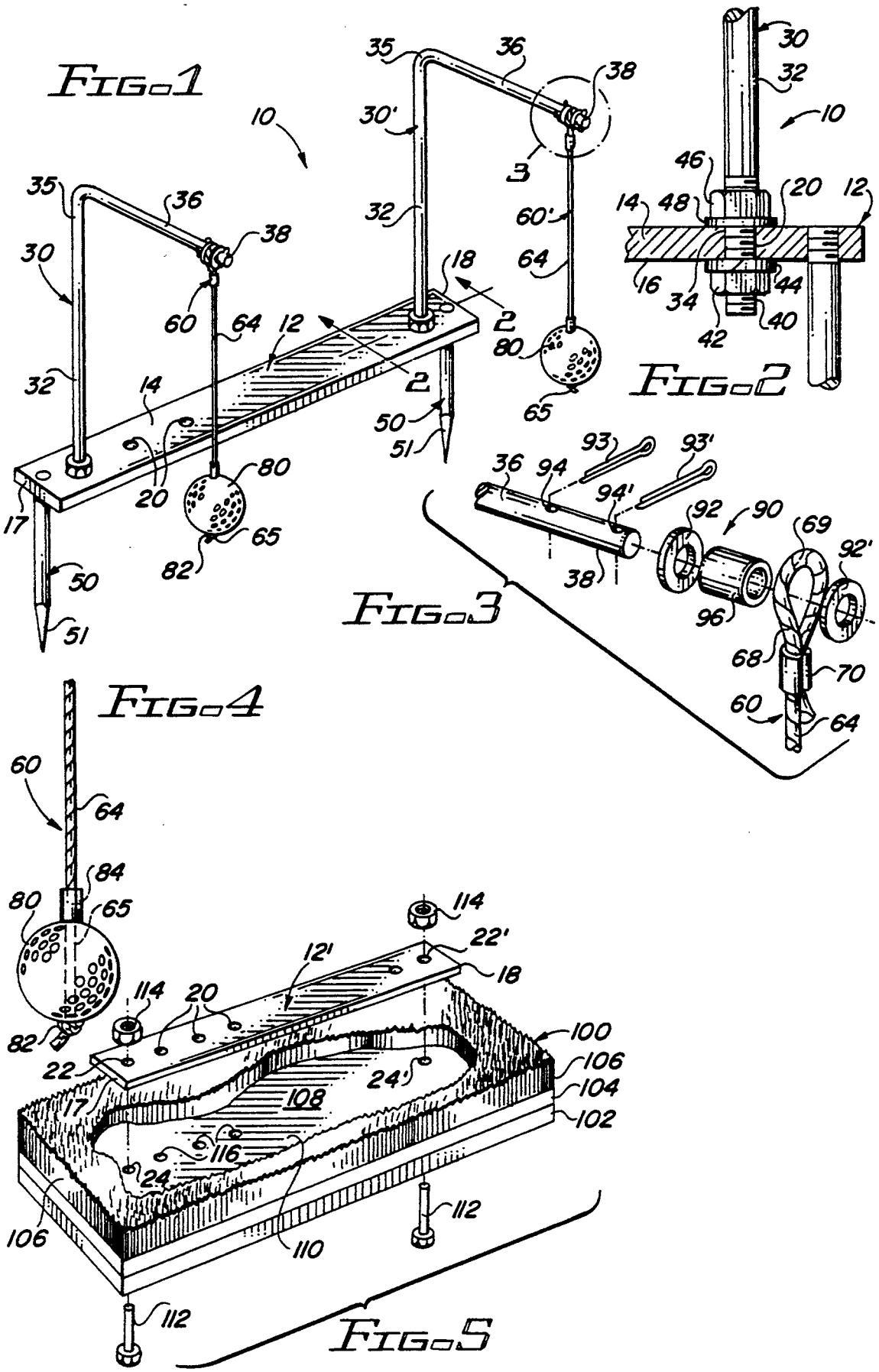
FIG. 1 is a perspective view of the golf swing training apparatus of the present invention.
FIG. 2 is an isolated sectional view taken along the line 2—2 of FIG. 1.
FIG. 3 is an isolated, exploded view of component parts taken from the area indicated by the circle 3 in FIG. 1.
FIG. 4 is an isolated elevational view illustrating attachment of a ball to a lower end of a tethering cord of the present invention.
FIG. 5 is an exploded view, shown in perspective, of an alternative anchoring assembly of the present invention.

The golf swing training apparatus of the present invention is shown generally as 10 in FIG. 1 and includes a base plate 12 having an upper surface 14, a lower surface 16 (see FIG. 2) and opposite ends 17 and 18. The base plate is provided with a plurality of apertures 20 formed therethrough in spaced, aligned relation to one another.

A pair of individual L-shaped arm members 30, 30' each include a vertical extension 32 having a lower proximal end zone 34 and an upper end defined at an elbow 35 from which extends a horizontal extension 36 which terminates at a distal end zone 38.

In a preferred embodiment, the lower proximal end zone 34 of each of the arm members 30, 30' is sized and configured for receipt through any selected one of the apertures 20 in the base plate. The lower proximal end zone is preferably threaded as at 40 so that once received through a select one of the apertures 20, with a portion of the proximal end zone extending below the bottom side of the base plate, a lock nut 42 and washer 44 are threadably advanced on the threaded proximal end zone to secure the respective arm member to the base plate at the desired location. To provide a secure attachment, a second nut 46 and washer 48 are fitted to the proximal end zone on the top side of the base plate, so that upon tightening down on the nuts 42, 46 the washers 44, 48 are caused to engage the respective bottom 16 and top 14 sides of the base plate 12 with the base plate sandwiched therebetween.

In order to anchor the base plate 12 to a ground surface, such as natural turf, a pair of spikes 50 are provided at opposite ends of the base plate, extending downwardly from the bottom side thereof and terminating at sharpened ends 51. Upon placing the apparatus 10 at a desired location on the supporting ground surface, stepping or pressing on the top side 14 of the base plate 12 causes the spikes 50 to be driven down into the ground surface, thereby maintaining the apparatus 10 in fixed, anchored position.

The apparatus 10 is further provided with first and second tether assemblies 60, 60' each rotatably attachable to the distal end zone 38 of a respective one of the arm members 30, 30'. The tether assemblies 60, 60' each include a tethering cord 64 having a lower end zone 65 and an opposite upper end zone 68 formed into a loop 69 by a fastener 70 which is crimped into gripping engagement with the two mating segments of the cord, as seen in FIG. 3.

Each of the tether assemblies further include a ball 80 attached to the lower end zone 65 of the tethering cord 64. The ball 80 may be attached to the lower end of the tethering cord by passing the lower end zone 65 of the cord through an axial bore passing through the center of the ball, and thereafter forming a knot 82 at the free end of the tethering cord so that the ball is prevented from slipping off of the cord. In order to prevent the ball 80 from riding up along the length of the tethering cord 64, a crimping element 84 is crimped into gripping engagement with the tethering cord adjacent the top of the ball 80.

Referring to FIG. 3 there is further illustrated a tether mounting assembly 90 structured to rotatably secure the upper looped end 69 of the tethering cord 64 to the distal end zone 38 of the respective arm member 30, 30'. The tether mounting assembly 90 includes a pair of washers 92, 92' adapted for receipt onto the distal end zone 38 to define annular shoulder members between which the upper looped end 69 is notably maintained. Once received on the distal end zone, the washers 90, 92' are prevented from moving outwardly relative to one another by a pair of cotter pins 93, 93' which pass through respective holes 94, 94' formed through the proximal end zone 38 on outboard sides of the washers, 92, 92'. A nylon sleeve 96 is specifically sized and configured for receipt onto the distal end zone 38 between the washers 92, 92' in tight fitting engagement therebetween, preventing the washers, 92, 92' from moving inwardly relative to one another. Prior to Placement of the washer 92' onto the distal end zone, the looped end 69 of the tethering cord is fitted about the sleeve 96. Thereafter, the washer 92' is placed on the proximal end zone and the respective cotter pin 93' is attached. The inner circumference of the loop 69 is slightly larger than the outer circumference of the cylindrical sleeve 96, permitting the loop 69 to be rotated thereabout. However, the inner circumference of the loop 69 is less than the outermost circumference of the washers 92, 92', thereby maintaining the loop 69 in captivated relation between the washers 92, 92'.

The length of each of the tethering cords 64 of the respective tether assemblies 60, 60' are preferably equal so that when attached to the distal end zone of the respective arm members, 30, 30' the balls 80 are supported in spaced relation to one another along a common horizontal plane defined by the proper path of a golf club head when hitting a golf ball.

The tether assemblies 60, 60' are specifically structured to cause the respective balls 80 to rotate about a horizontal axis defined by the horizontal extension 36 of the arm members 30, 30' upon striking the balls 80 with the club head when swinging a golf club. Accordingly, if the golf club is swung properly, and the club head travels through the proper straight follow-through path when hitting the balls, each of the balls 80 will be clearly and squarly struck, resulting in each ball being caused to rotate about the respective horizontal axis.

Referring to FIG. 5 there is illustrated an alternative anchoring means of the present invention for use on a floor surface or other hard surface wherein spikes cannot be used. In accordance with the embodiment of FIG. 5, there is provided a platform 100 having a bottom layer 102 formed of wood or metal, an intermediate layer 104 formed of a rubber or like resilient material and a top artificial turf layer 106. In this embodiment, the base plate 12' does not include spikes, but rather simply includes the plurality of apertures 20 formed therethrough, and additionally outermost apertures 22, 22' adjacent the opposite ends of the base plate 12'. The apertures 22, 22' are specifically positioned for axial alignment with corresponding apertures 24, 24' formed through the bottom layer 102 and intermediate layer 104 of the platform 100. In this manner, the base plate is secured to an upper surface 108 of the intermediate layer 104 within a recessed area 110 formed in the top artificial surface 106. The base plate 12' is secured thereto using conventional bolts 112 which extend upwardly through the aligned apertures 22, 24 and 22', 24', being secured by nuts 114 threadably fastened thereto.

In the embodiment illustrated in FIG. 5, the lower proximal end zones 34 of the respective arm members 30, 30' attach to the base plate 12' in the same manner as illustrated in FIG. 2. Holes 116 are provided through the top surface of the intermediate layer 106 to accommodate the proximal end and nut 42 on the bottom side 16 of the base plate 12 so that the bottom side of the base plate properly engages the upper surface 108 of the intermediate layer 106.

While this invention has been shown and described in what is considered to be preferred embodiments thereof, it is recognized that departures may be made within the spirit and scope of the invention which should not therefore be limited except by the following claims and within the Doctrine of Equivalents.

Now that the invention has been described,

What is claimed is:

1. A golf training apparatus for use on a support surface, comprising:

a base plate including a top side, a bottom side, and opposite ends, a pair of individual arm members each including a vertical extension having a lower proximal end zone and a horizontal extension having a distal end zone, said horizontal extension defining a horizontal axis, means for anchoring said base plate in fixed relation to the support surface, attachment means for releasably attaching said proximal end zones of each of said arm members to said base plate at one of a plurality of select locations between said opposite ends thereof such that said distal end zones of said arm members are disposed in spaced relation to one another above the support surface, first and second tether assemblies each being associated with a respective one of said arm members and each including:

a tethering cord including a lower end and an opposite upper end rotatably secured to said distal end zone of said respective arm member, a spherical member resembling a golf ball and fixedly attached to said lower end of said tethering cord and supported in spaced relation above the support surface, and wherein each of said tether assemblies are structured and disposed to cause said respective ball to rotate about said horizontal axis upon applying an external striking force to said ball.

2. The apparatus as recited in claim 1 wherein said anchoring means includes a plurality of elongate spikes extending downwardly from said bottom side of said base plate and being structured for anchoring receipt into a ground surface defining the support surface.

3. The apparatus as recited in claim 1 wherein said anchoring means includes a platform including an upper side and a lower side adapted for mating engagement with the support surface, the upper side being structured and configured for mounting of said base plate thereto.

4. The apparatus as recited in claim 1 further including a pair of tubular sleeves each being sized and configured for receipt about a respective one of said distal end zones of said arm members.

5. An apparatus as recited in claim 4 wherein said distal end zones of said arm members are each provided with a pair of annular shoulder members disposed in spaced relation to one another on opposite sides of said tubular sleeve.

6. The apparatus as recited in claim 5 wherein said upper end of said tethering cord includes a closed loop structured for rotating receipt about corresponding one of said sleeves, said closed loop being maintained and captivated on said sleeve by said annular shoulder members.

7. The apparatus as recited in claim 1 wherein said tethering cords of said first and second tether assemblies are of equal length such that said spherical members on each of said respective tethering cords are disposed in coplanar relation relative to one another on a common horizontal plane.

* * * * *